US006427790B1

(12) United States Patent
Burr

(10) Patent No.: US 6,427,790 B1
(45) Date of Patent: Aug. 6, 2002

(54) ROCK BIT FACE SEAL HAVING LUBRICATION GAP

(75) Inventor: Bruce H. Burr, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/683,022

(22) Filed: Nov. 8, 2001

(51) Int. Cl.[7] ..... E21B 10/22
(52) U.S. Cl. ..... 175/371; 277/400
(58) Field of Search ..... 125/371, 372, 125/227, 228; 277/336, 390, 366, 400

(56) References Cited

U.S. PATENT DOCUMENTS

| | | | | |
|---|---|---|---|---|
| 3,137,508 A | | 6/1964 | Cunningham | |
| 3,370,895 A | | 2/1968 | Cason, Jr. | |
| 3,529,840 A | | 9/1970 | Durham et al. | |
| 3,645,591 A | | 2/1972 | Winberg | |
| 3,713,707 A | | 1/1973 | Bennett | |
| 3,761,145 A | | 9/1973 | Schumacher, Jr. | |
| 4,172,502 A | | 10/1979 | van Nederveen | |
| 4,176,848 A | | 12/1979 | Lafuze | |
| 4,178,045 A | | 12/1979 | Neilson | |
| 4,199,156 A | | 4/1980 | Oldham et al. | |
| 4,248,485 A | | 2/1981 | White et al. | |
| 4,249,622 A | | 2/1981 | Dysart | |
| 4,306,727 A | | 12/1981 | Deane et al. | |
| 4,344,629 A | | 8/1982 | Oelke | |
| 4,359,111 A | | 11/1982 | Gonzalez | |
| 4,394,020 A | | 7/1983 | Oelke | |
| 4,466,622 A | | 8/1984 | Deane et al. | |
| 4,494,749 A | | 1/1985 | Evans | |
| 4,516,640 A | | 5/1985 | Karlsson | |
| 4,516,641 A | | 5/1985 | Burr | |
| 4,613,005 A | | 9/1986 | Olsson | |
| 4,629,338 A | | 12/1986 | Ippolito | |
| 4,666,001 A | | 5/1987 | Burr | |
| 4,671,368 A | | 6/1987 | Burr | |
| 4,747,604 A | | 5/1988 | Nakamura | |
| 4,753,303 A | | 6/1988 | Burr | |
| 4,753,304 A | | 6/1988 | Kelly, Jr. | |
| 4,762,189 A | | 8/1988 | Tatum | |
| 4,822,057 A | | 4/1989 | Chia et al. | |
| 4,824,123 A | * | 4/1989 | Chia et al. | 277/84 |
| 4,838,365 A | * | 6/1989 | Kotch | 175/371 |
| 4,903,786 A | | 2/1990 | Welsh | |
| 4,923,020 A | | 5/1990 | Kelly, Jr. et al. | |
| 5,009,519 A | | 4/1991 | Tatum | |
| 5,027,911 A | | 7/1991 | Dysart | |
| 5,040,624 A | | 8/1991 | Schumacher et al. | |
| 5,080,183 A | * | 1/1992 | Schumacher et al. | 175/371 |
| 5,080,378 A | | 1/1992 | Kagawa | |
| 5,195,754 A | | 3/1993 | Diette | |
| 5,295,549 A | | 3/1994 | Dolezal et al. | |
| 5,360,076 A | | 11/1994 | Kelly, Jr. et al. | |
| 5,465,800 A | | 11/1995 | Pearce et al. | |
| 5,472,058 A | * | 12/1995 | Hooper et al. | 175/371 |
| 5,791,421 A | * | 8/1998 | Lin | 175/371 |
| 5,875,861 A | | 3/1999 | Daly et al. | |
| 6,109,376 A | * | 8/2000 | Pearce | 175/371 |
| 6,176,330 B1 | * | 1/2001 | Burr | 175/371 |
| 6,247,545 B1 | | 6/2001 | Burr et al. | |

* cited by examiner

*Primary Examiner*—William Neuder
(74) *Attorney, Agent, or Firm*—Jeffery E. Daly; Brigitte Jefferey; John J. Ryberg

(57) ABSTRACT

A seal arrangement useful in a rolling cutter rock drill bit includes a pair of rigid rings disposed between the leg of the bit body and the rolling cutter. The rings have opposing faces, which have opposing sealing surfaces. The sealing surfaces occupy a portion of the faces and include wear resistant material. A gap is formed between a portion of the faces, the gap allowing lubrication to flow to the sealing surfaces from the bit's bearing cavity.

21 Claims, 4 Drawing Sheets

ROCK BIT FACE SEAL HAVING LUBRICATION GAP

BACKGROUND OF THE INVENTION

1. Field of the Invention

The present invention provides an enhanced rigid face seal for roller cone rock bits. More particularly, the seal arrangement of the present invention allows for enhanced face seal lubrication.

2. Description of the Related Art

In the field of rolling cutter rock drill bits, it is desirable to include dynamic sealing systems that will generally prevent the loss of lubricant from the bearing system as well as the entry of abrasive laden drilling fluid into the bearing system from outside the bit.

There are two basic types of sealing systems commonly used in rolling cutter drill bits. In most drill bits, an elastomeric compression type sealing system is used to seal the bearing system. These bits are believed to perform adequately in most drilling applications. For rock bits used in very severe bit applications, however, elastomeric seals are known to have operating limitations when used to provide the dynamic seal around the bearing system.

Mechanical rigid face seals have generally become widely used as the seal of choice for dynamically sealing the bearing systems in rock bits used in severe drilling environments. These seals are typically manufactured from materials that tolerate the thermal, chemical and mechanical attack of severe drilling environments. The rigid face seals are generally believed to provide a higher level of reliability in rock bits as compared to elastomer seals.

A typical prior art mechanical rigid face seal for rock bits is shown in FIG. 1 as including a pair of seal rings 50, 60 having opposing faces 52, 62. The faces 52, 62 have opposing sealing surfaces 54, 64 that form a dynamic sealing interface 90. As the sealing surfaces 54, 64 rotate relative to each other, they are typically urged together at a controlled force by one or more energizers (not shown), as disclosed for instance in U.S. Pat. Nos. 5,040,624, 4,838,365, 3,761,145 and 6,176,330, each of which is hereby incorporated herein by reference in its entirety. Although generally more expensive than elastomer seals, mechanical face seals are believed to better withstand the typically highly abrasive environment of rock bit drilling, assuring a level of performance in rock drilling bits which is believed to justify their higher cost.

Still referring to FIG. 1, one of the seal rings 50, 60 of the typical conventional mechanical rigid face seal design for use in rotary rock bits is formed with a gradually tapered shape, or spherical radius, 86 adjacent to and on the lubricant side of the sealing interface 90. This seal design creates a diverging geometry. As abrasives wear the outer periphery of the engaged sealing surfaces 54, 64 of the faces 52, 62, the diverging geometry facilitates inward movement of the engaged sealing surfaces 54, 64 (also known as the sealing band) across the faces 52, 62. During the life-span of the bit, the sealing surfaces 54, 64 and sealing interface 90 are thus known to migrate across the opposing faces 52, 62 from the outer diameter OD toward the inner diameter ID of the seal rings 50, 60. The spherical radius 86 must be gradual enough to allow the migrating sealing surfaces 54, 64 to maintain their approximate initial widths and sufficient contact with one another. At the same time, it is important to maintain a sufficient film of lubricant between the sealing surfaces (e.g. 54, 64) of the seal faces. If the film becomes too thin, frictional contact between the sealing faces can generate undesirable heat and high torque on the seal faces. Excess frictional heat can damage and ultimately disable components used with the rigid rings, such as elastomer energizers and ring positioners, and bearing system components. High torque can also have undesirable consequences. For instance, if elastomer energizers are transmitting the torque, they may slip. A small amount of slippage can cause excessive wear on the elastomer energizers, leading to an early failure. For another example, when coil spring energizers, such as shown in U.S Pat. No. 4,838,365, are transmitting the torques, it is possible, under some circumstances, for the coil spring energizers to fail. When the operating torques become too high, the shear forces on the coil springs can cause them to yield. Once any one of the springs yield, the seal assembly loses its ability to move in response to volume changes in the lubricant near the seal, leading to rapid seal failure.

Referring again to FIG. 1, in the conventional seal design, the lubricant passes through the minute space 88 formed between the seal faces 52, 62 by the gradually tapered shape, or spherical radius, 86. In an exemplary prior art design, this space is approximately 0.004 inches at its open end and decreases along the tapered face 52 to virtually nothing. The spherical radius on one ring of the conventional seal face geometry thus provides for both lubrication of the sealing surfaces, and an area for the sealing band to migrate across as axial face wear occurs. Under this seal design, if the spherical radius 86 is sized incorrectly, the sealing interface 90 cannot be maintained as the seal faces 52, 62 wear, and the seal will prematurely fail.

In considering existing technology for roller cone rock bits, there remains a need for a rigid face seal arrangement that provides enhanced lubrication to the sealing interface, reduces seal face heat checking, is cost-effective, relatively simple to manufacture, durable and/or can be used with existing bit components, or a combination thereof.

SUMMARY IF INVENTION

The invention is useful in rolling cutter rock drill bits having a bit body with at least one depending leg, a bearing shaft formed on the leg(s), a rolling cutter rotatably mounted upon the bearing shaft, a bearing cavity formed in the rolling cutter and a lubricant disposed within the bearing cavity. In accordance with certain embodiments, the invention includes a pair of energized rigid face seals disposed between each leg and the rolling cutter and having opposing seal faces. The seal faces include opposing engagable sealing surfaces, which are constructed at least partially of generally wear-resistant material. A "distinct" gap is formed between at least part of the faces, in fluid communication with the bearing cavity and allows lubricant to flow from the bearing cavity to the sealing surfaces.

The seal faces may include opposing non-engageable surfaces. At least one of the faces may include a stepped geometry. At least one of the sealing surfaces may include a beveled inner edge adjacent to the non-engageable surface. The generally wear-resistant material may include a tungsten carbide coating.

If desired, the sealing surfaces may be designed not to substantially migrate across the faces throughout the life of the rolling cutter rock bit under normal operating conditions. The gap may, if desired, be formed with a width of between approximately 0.005 inches and 0.010 inches.

Various embodiments of the present invention include a seal arrangement that has two rigid rings disposed between the leg of the bit body and the rolling cutter, the rigid rings having inner adjacent sides in fluid communication with the bit's bearing cavity. The rings have opposing faces, which have opposing sealing surfaces. Each sealing surface occupies a portion of its respective face, includes wear resistant material and is generally non-migrating across its respective face. A gap is formed between a portion of the faces, extends from the inner side of each ring to the sealing surfaces of faces and allows lubrication to flow to the sealing surfaces from the bearing cavity.

In some embodiments of the invention, the seal arrangement includes first and second rigid rings positionable between the leg of the bit body and the rolling cutter, each ring having a first side in fluid communication with the bit's bearing cavity when the seal arrangement is assembled within a rolling cutter rock drill bit. The rigid rings have opposing sealing faces, which include opposing seal interface surfaces that have a wear resistant coating. A distinct gap is formed between the sealing faces when the seal arrangement is assembled within the bit, the gap extending from the seal interface surfaces to the first side of each rigid ring.

The present invention also includes embodiments having two rigid rings disposed between the leg of the bit body and the rolling cutter, each rigid ring having a first side in fluid communication with the bearing cavity of a bit. The rigid rings have opposing faces, the faces having opposing seal interface surfaces. Each seal interface surface includes a wear resistant coating. The face of at least one of the rigid rings also has a non-engageable surface disposed adjacent to the first side of the ring, the non-engageable surface being non-engageable with the face of the other rigid ring and forming a gap between the faces. The gap allows the flow of lubricant to the first and second seal interface surfaces.

Accordingly, the present invention includes features and advantages which enable it to advance the technology associated with roller cone rock bits. Characteristics and advantages of the present invention described above, as well as additional features and benefits, will be readily apparent to those skilled in the art upon consideration of the following detailed description of preferred embodiments and referring to the accompanying drawings.

BRIEF DESCRIPTION OF DRAWINGS

For a detailed description of preferred embodiments of the invention, reference will now be made to the accompanying drawings.

DETAILED DESCRIPTION

Figure 1:
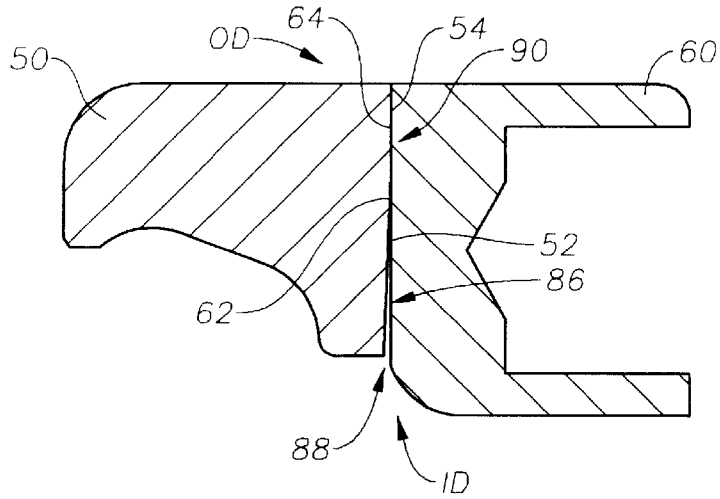
Fig. 1 (Prior Art)
FIG. 1 is an enlarged cross section of a pair of prior art mechanical rigid face seals for rolling cutter rock bits.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout the various portions of this patent specification, the terms "invention", "present invention" and variations thereof are not intended to mean the claimed invention of any particular of the appended claim or claims, or all of the appended claims. These terms are used to merely provide a reference point for subject matter discussed in this specification. The subject or topic of each such reference is not necessarily part of, or required by, any particular claim(s) merely because of such reference. Thus, the use herein of the terms "invention", "present invention" and variations thereof is not intended, and should not be used, to limit the construction or scope of the appended claims.

Figure 3:
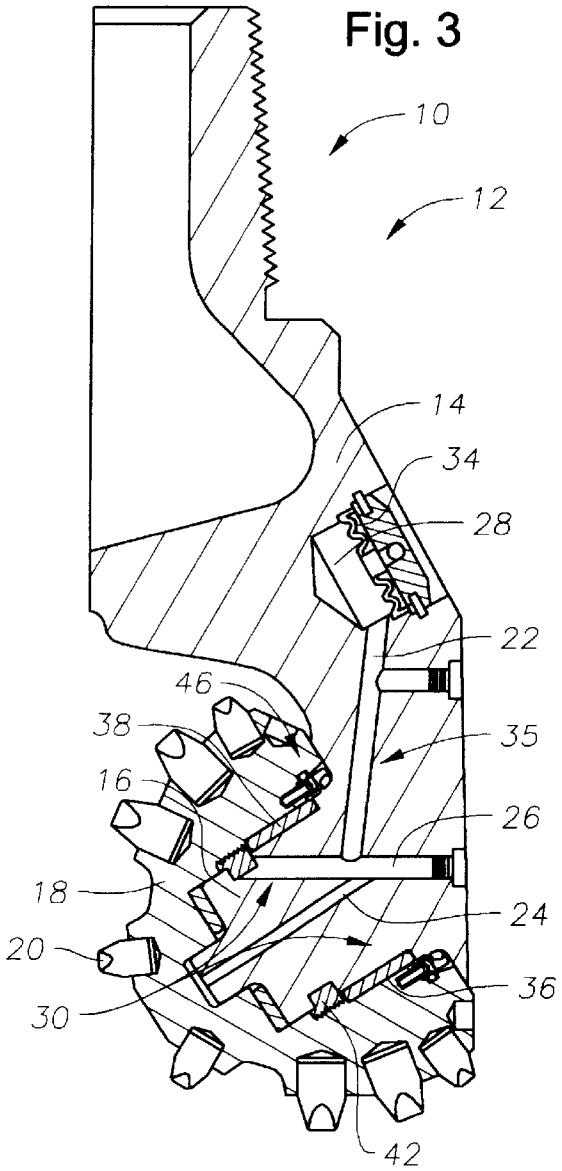
FIG. 3 is a cross section view through one leg of a rolling cutter drill bit having one embodiment of a seal arrangement in accordance with the present invention.
Figure 2:
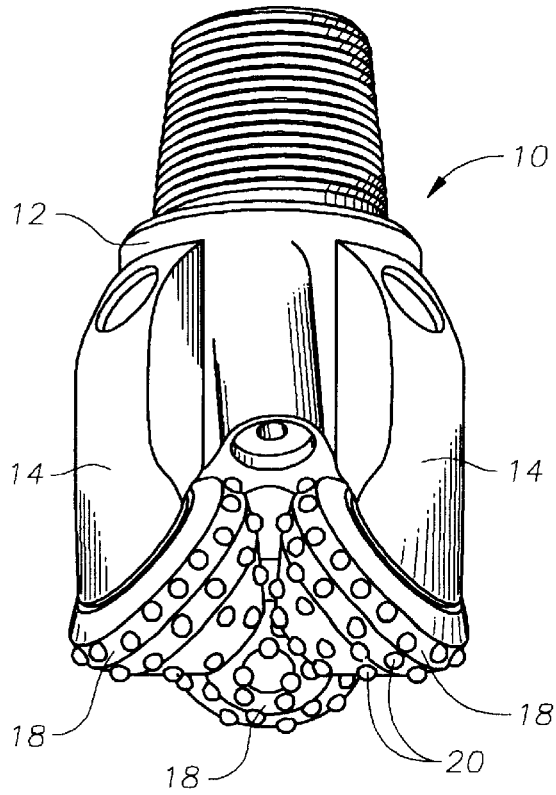
FIG. 2 is a perspective view of a typical rolling cutter drill bit.

Referring initially to FIGS. 2 and 3, an exemplary rolling cutter rock drill bit 10 within which the present invention may be used is shown. A "rolling cutter rock drill bit" is also commonly called a rock bit, a rolling cutter drill bit or an oilfield drill bit. The illustrated bit 10 includes a body 12 having three legs 14. In this type of bit, as is known in the art, a cantilevered bearing shaft 16 formed on each leg 14 extends inwardly and downwardly and is capable of carrying a rotatably mounted rolling cutter 18. Attached to each illustrated rolling cutter 18 are hard, wear resistant cutting inserts 20, which are capable of engaging the earth to effect a drilling action and cause rotation of the rolling cutter 18.

Referring specifically to FIG. 3, each leg 14 of the exemplary bit also has a bearing system 35. The bearing system 35 of the illustrated leg 14 is a friction bearing system, which includes a friction bearing member 36 mounted in a bearing cavity 38 formed in each rolling cutter 18. The friction bearing member 36 is designed to carry radial loads imposed upon the rolling cutter 18 during drilling. A retention bearing member 42 is mounted in the rolling cutter 18 to retain the rolling cutter 18 upon the bearing shaft 16 during drilling. It should be understood, however, that any other suitable type of bearing system, such as a roller bearing system, with any suitable components can be used in one or more legs 14 of the bit 10 (FIG. 2).

Still referring to the bit configuration of FIG. 3, a bearing lubricant (not shown) is inserted into internal passageways 22, 24, and 26, a reservoir 28 and a bearing area 30 of the leg 14 during bit assembly. As is known in the art, pressure balancing diaphragm 34 equalizes the pressure between the drilling fluid and the lubricant and typically includes a built-in pressure relief mechanism that releases lubricant into the drilling fluid when a predetermined pressure differential is reached. Further explanation of the components, arrangement and operation of exemplary rolling cutter rock drill bits are well known in the art and can be found in prior art patents and other publications.

The above description and further fundamental aspects of rolling cutter rock bits are in no way limiting upon the present invention or the appended claims. The present invention does not require the particular bit configuration, components and details of construction and operation described above, but can be used with any operational rolling cutter rock drill bit. Thus, the above description is not intended to and should not limit the present invention or the appended claims.

Figure 4:
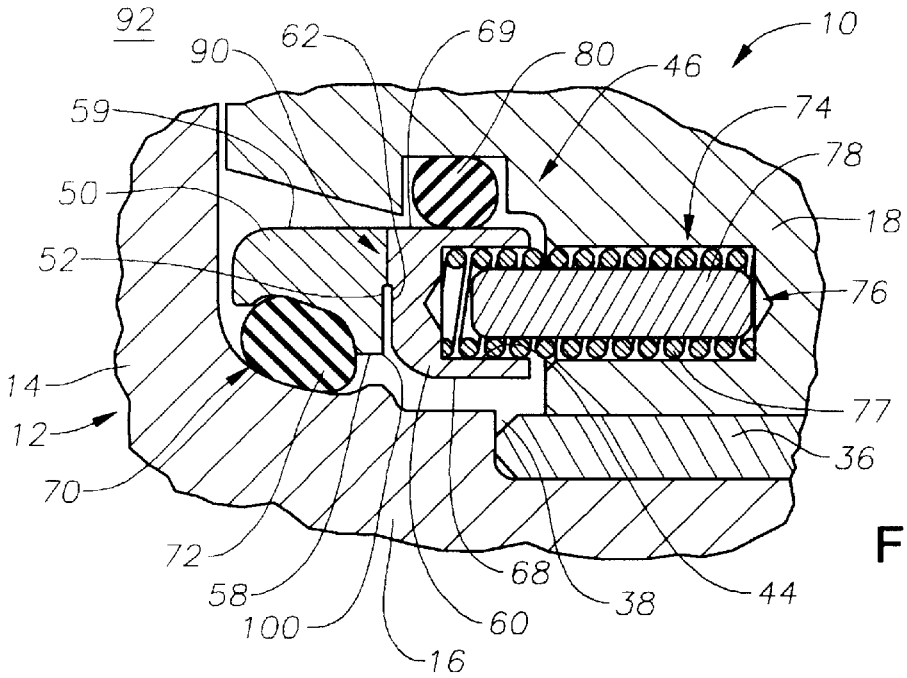
FIG. 4 is an enlarged cross section view of the exemplary seal arrangement shown in FIG. 3.

Now referring to FIGS. 3 and 4, a seal arrangement 46 in accordance with the present invention is shown. The seal arrangement 46 includes two mating rigid rings 50, 60 that have opposing engaging faces 52, 62, respectively, and are positioned between the leg 14 and the rolling cutter 18 to dynamically seal the bearing cavity 38. Typically, the seal arrangement 46 would be included in each leg 14 of the bit 10, although the quantity of legs 14 and seal arrangements 46 in a bit is not limiting upon the present invention.

In the particular embodiment of FIG. 4, for example, the rigid ring 50 is shown engaged and sealed with the bearing shaft 16 of the leg 14 via an energizer 70, while the rigid ring 60 engages and seals with the rolling cutter 18 via an energizer 74 and elastomer seal 80. The energizer 70 of this example is an elastomer seal 72. The illustrated energizer 74 is a spring assembly 76, which includes numerous coil springs 77 each disposed in a recess 44 at various locations around the circumference of the rigid ring 60 and may also include at least one pin 78 disposed in a spring 77, such as disclosed in U.S. Pat. Nos. 6,176,330, which is hereby incorporated by reference herein in its entirety. In this embodiment, rigid ring 50 does not rotate with respect to the bearing shaft 16 under normal operating conditions and is considered stationary. The rigid rings 50, 60 are, in this example, permitted to move axially by the energizer 70 and elastomer seal 80, respectively.

Still referring to FIG. 4, the energizers 70, 74 of this embodiment bias the rigid rings 50, 60 into engagement with one another, establishing a dynamic sealing interface 90. It should be understood, however, that the present invention requires neither the particular disposition of the rigid rings 50, 60 between the leg 14 and rolling cutter 18 discussed above and shown in the appended figures, nor the components for positioning and biasing the rings 50, 60 discussed above and shown in the appended figures. For example, the ring 60 need not be energized by a spring assembly 76 and need not necessarily have the recesses 44. Any suitable components for positioning and biasing the rings 50, 60, as is or become known in the art, may be used. Likewise, any suitable disposition and location of the rings 50, 60 may be used. Thus, the above description of the particular seal disposition of FIG. 4 and components for positioning and biasing the rings 50, 60 is not intended to and should not limit the present invention or the appended claims.

Still with reference to FIG. 4, the exemplary rigid rings 50, 60 are constructed of stainless steel, such as AISI 440C (UNS S44004) steel, although any other suitable material that is or becomes known may be used. The rigid rings 50, 60 have adjacent inside sides 58, 68, respectively, which are generally in fluid communication with the bearing cavity 38. These sides 58, 68 of the rigid rings 50, 60 are thus on the "lubrication" side of the seal arrangement 46. The rigid rings 50, 60 also have adjacent outside sides 59, 69, which are typically in fluid communication with the exterior 92 of the bit 10, such as a borehole (not shown), and are typically subject to contact with drilling fluid containing abrasive material during use.

Figure 5:
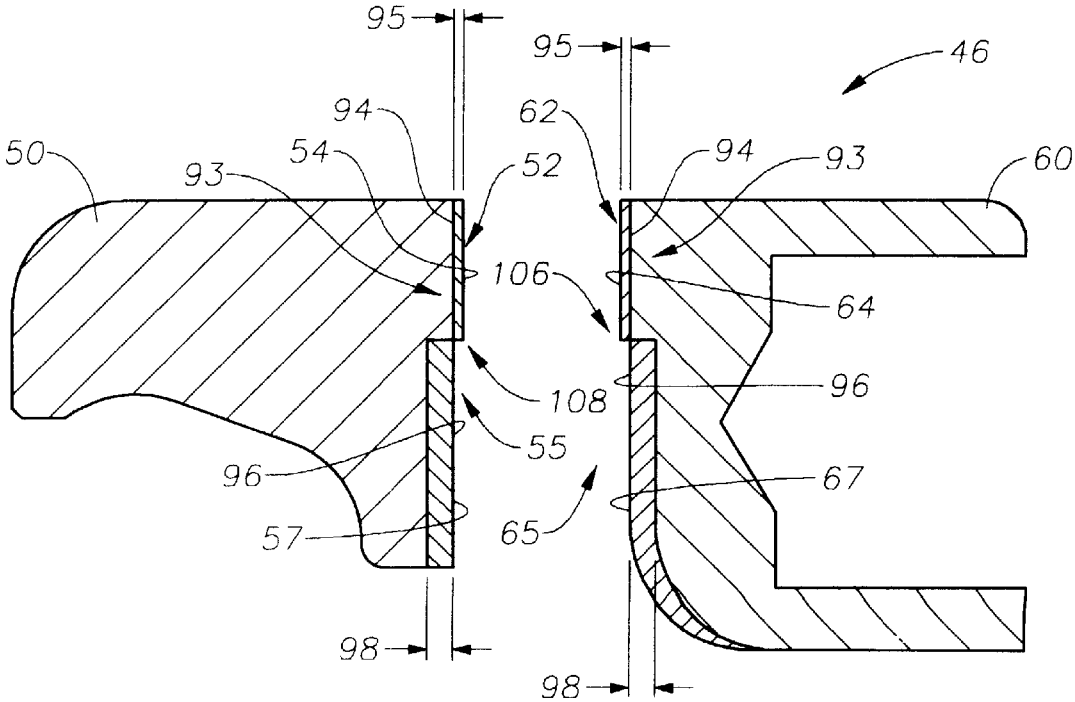
FIG. 5 is an enlarged cross section view of the exemplary rigid rings of FIG. 4 shown prior to being inserted in a bit.
Figure 6:
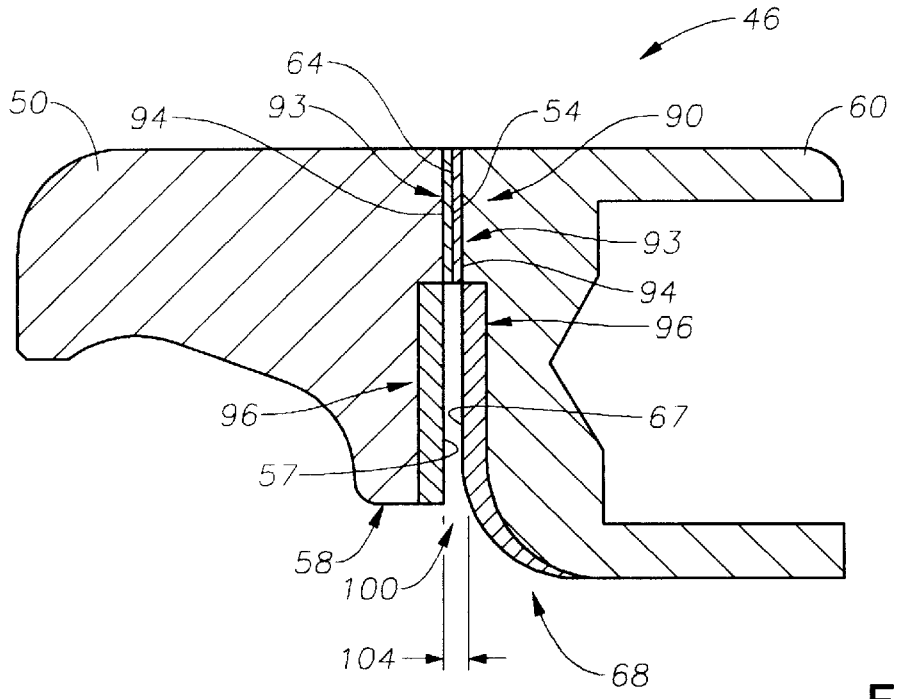
FIG. 6 is an enlarged cross section view of the exemplary rigid rings shown in FIG. 4.

Now referring to FIGS. 5 and 6, the respective faces 52, 62 of the rigid rings 50, 60 include sealing surfaces 54, 64 that occupy only a part of the faces 52, 62 and are capable of creating and maintaining the dynamic sealing interface 90 without substantially moving, or migrating, across the seal faces 52, 62 as the rigid rings 50, 60 wear during normal operational use of the bit. In the embodiment shown, for example, the sealing surfaces 54, 64 are at least substantially planar, or flat, and include at least substantially wear resistant material 93. The exemplary material 93 used in a 12¼ diameter rolling cutter drill bit is a coating 94 of tungsten carbide having a finished thickness 95 of between approximately 0.003 inches and approximately 0.005 inches. For example, the coating 94 on each surface 54, 64 may be applied by a spraying technique to an initial thickness (not shown) of approximately 0.010 inches, and finished to a smooth sealing surface having a thickness 95 of approximately 0.005 inches by grinding, lapping and polishing, as is known in the art.

However, the sealing surfaces 54, 64 can include any suitable, effective wear resistant material of any suitable thickness and applied and treated (finished or non-finished) in any suitable desirable manner. For example, the sealing surfaces 54, 64 could be coated with titanium nitride or chromium nitride. For another example, the rigid rings 50, 60 could be entirely, or partially constructed of suitable wear resistant material. Thus, the form, composition, dimensions and other characteristics of the suitable wear resistant material are not limiting upon the present invention.

Still referring to FIGS. 5 and 6, the rigid rings 50, 60 are designed to allow a space, or gap, 100 between at least a portion of the faces 52, 62 when the seal arrangement 46 is assembled within the bit 10 (FIG. 4). The gap 100 is located and sized to allow lubricant to flow to the sealing surfaces 54, 64. If desired, the gap 100 may be considered a "distinct gap", which for the purposes of this patent specification and the appended claims, means a gap formed at least partially between opposing, engaged, rigid ring faces and capable of allowing lubricant to flow to the sealing surfaces of the faces sufficient to reduce face heat checking during use as compared to a prior art face seal arrangement (e.g. FIG. 1).

In the particular embodiment illustrated in FIGS. 4–6, the gap 100 extends from the inside side 58, 68 of each rigid ring 50, 60 to the sealing surfaces 54, 64 and has a width 104 of between approximately 0.005 and approximately 0.010 inches. The results of field tests showed a greater likelihood of face heat checking at the seals of bits equipped with prior art face seals (e.g. FIG. 1) as compared to the seals of bits having seal arrangements 46 made in accordance with the present invention.

Figure 7:
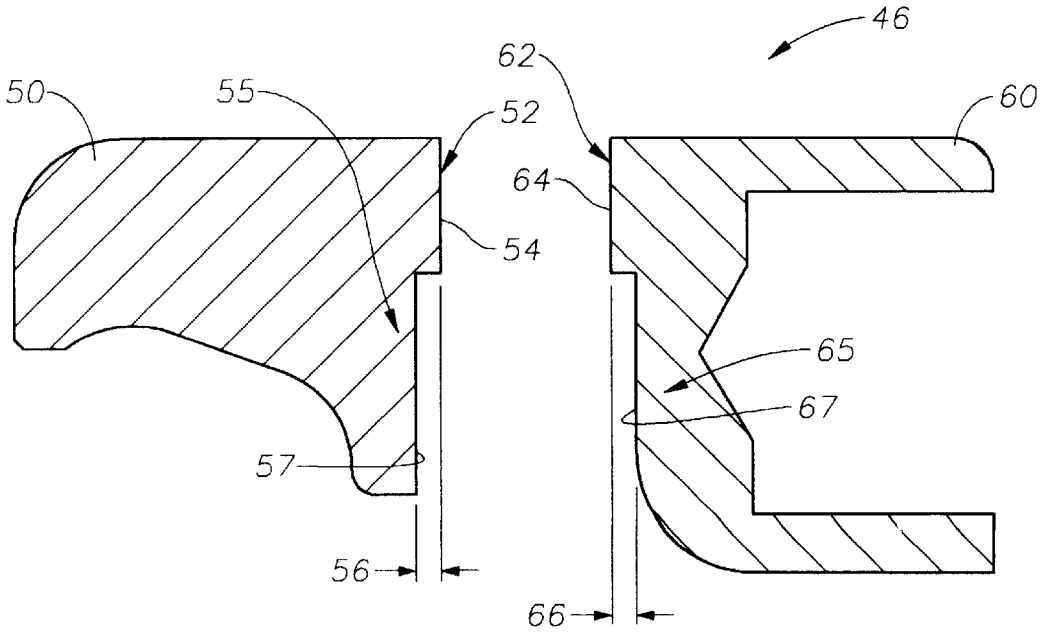
FIG. 7 is an enlarged cross section view of the exemplary rigid rings of FIG. 5 prior to the inclusion of substantially wear resistant material.

Now referring to FIGS. 5–7, the gap 100 of the illustrated embodiment is formed by a "stepped" geometry, or configuration, of each face 52, 62. The stepped configuration includes a portion 55, 65 of each face 52, 62 that is indented relative to the corresponding sealing surface 54, 64. The indented portions 55, 65 create no-engagement surfaces 57, 67 on the rings 50, 60, respectively. The faces 52, 62 do not make contact at the non-engagement surfaces 57, 67, the non-engagement surfaces 57, 67 thus forming the gap 100.

For example, the indented portions 55, 65 may be machined to the desired depth 56, 66 around the inner diameter, or circumference, of the rigid rings 50, 60 during manufacturing. In the illustrated embodiment, the indented portions 55, 65 are formed with a depth 56, 66 of approximately 0.010 inches and covered with a tungsten carbide coating 96 similarly as the coating 94 applied to the sealing surfaces 54, 64. In this example, the coating 96 has a thickness 98 of approximately 0.010 inches, but is not finished to a smooth sealing surface, such as by grinding, lapping and polishing, as are the sealing surfaces 54, 64. Thus, after the sealing surfaces 54, 64 are finished, the gap width 104 is approximately 0.010 inches.

Referring specifically to FIG. 5, the geometry of the faces 52, 62 may create opposing sharp corners 106 of wear resistant material 93 on the sealing surfaces 54, 64, such as adjacent to the indented portion(s) 55, 65. During use, if the corners 106 contact one another and bear a substantial load, the wear resistant material 93 may be overloaded and damaged, such as by cracking and/or flaking. To assist in preventing such potential result, loading of the sharp corners 106 may be reduced or avoided, such as by altering at least one of the corners 106. For example, at least one of the corners 106 may be formed as a beveled corner 108.

However, the present invention is not limited to the details of the gap and seal geometry of the illustrated embodiment as described in the previous four paragraphs. The dimensional and physical properties of the rigid rings and gap may vary depending upon various factors, such as bit size, operating environment and desired performance capabilities. Any suitable gap configuration and seal geometry may thus be used. For example, when indented portions (e.g. 55, 65, FIG. 5) are used, the indented portions may be formed in any suitable manner and with any suitable, desired configuration. The indented portions need not have any particular depth and need not include any wear resistant material. If wear resistant material is included, it need not be limited to the depth, composition or configuration described above; any suitable wear resistant material configuration may be used.

Further, one or both indented portions may be formed along less than the entire inner diameter, or circumference, of the rigid rings, if suitable. For another example, the indented portions can have differing depths. Yet further, the depth of the indented portion(s) may be varied around the inner diameter of the ring(s). For still another example, the corner(s) 106, if included, need not be altered by beveling, or may not be altered at all.

Figure 8:
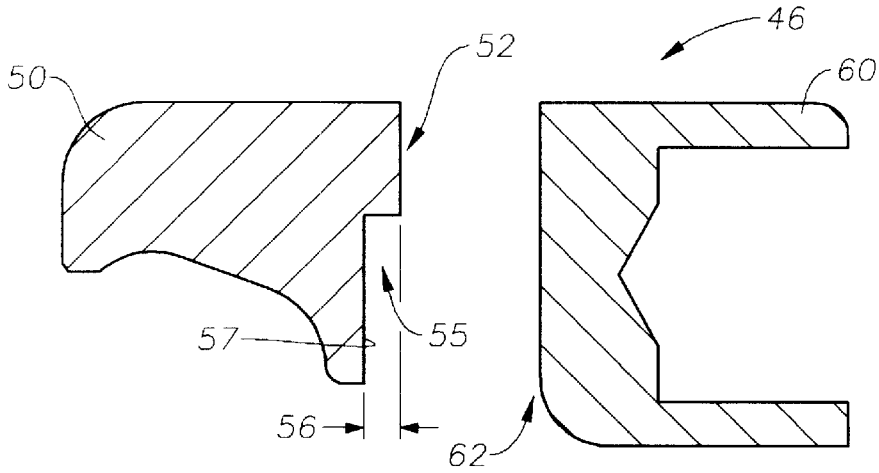
FIG. 8 is an enlarged cross section view of another embodiment of a pair of rigid rings useful in a seal arrangement in accordance with the present invention.
Figure 9:
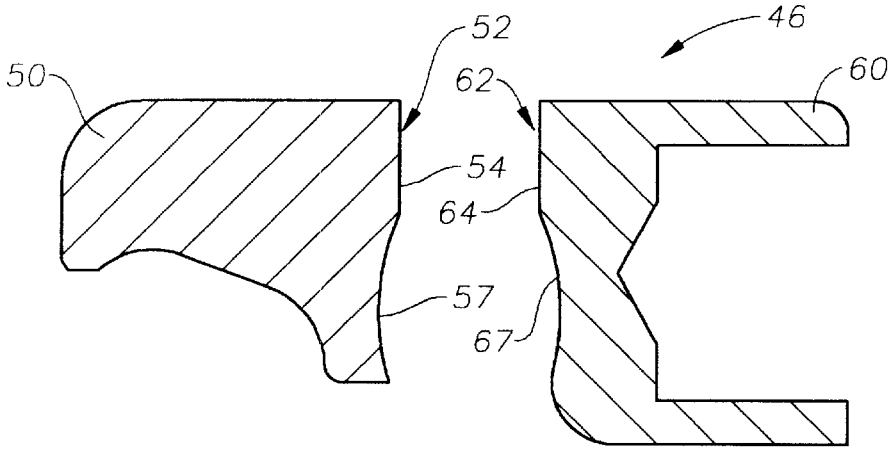
FIG. 9 is an enlarged cross section view of yet another embodiment of a pair of rigid rings useful in a seal arrangement in accordance with the present invention.
Figure 10:
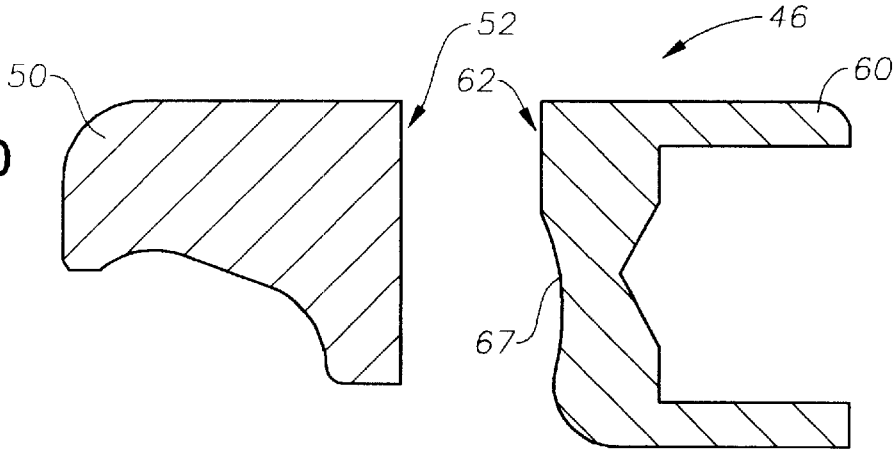
FIG. 10 is an enlarged cross section view of still a further embodiment of a pair of rigid rings useful in a seal arrangement in accordance with the present invention.

Yet further, the gap width is not limited to any particular size, or size range, and the seal faces of the rigid rings need not have any particular geometry for forming the gap, as long as the gap is sufficient to allow lubricant to flow to the sealing surfaces of the seal faces. For example, both faces need not be formed with a "stepped" geometry, such as described above. Instead, only one among the faces (52, 62) can be formed with a stepped geometry, such as shown in FIG. 8. In such embodiment, only the face 52 has an indented portion 55, the indented portion 55 having a depth 56 allowing a sufficient gap width (not shown). In yet other embodiments, a "stepped" configuration need not even be used for forming the gap (100); any suitable face geometry may be used. For example, FIGS. 9 and 10 illustrate embodiments of rigid rings 50, 60 not having a stepped face geometry. In these embodiments, at least one of the non-engagement surface 57, 67 has a curved geometry.

Preferred embodiments of the present invention are thus well adapted to carry out one or more of the objects of the invention. The present invention offers advantages over the prior art and additional capabilities that have not been specifically addressed herein but are, or will become, apparent from the description herein, the appended drawings and claims. Various features and subcombinations of the present invention are of utility and may be employed without reference to other features and subcombinations. This is contemplated and within the scope of the appended claims.

The present invention is not limited to the above examples and details, and does not require each of the above aspects or features. While preferred embodiments of the invention have been shown and described, many variations, modifications and changes, such as in the components, details of construction, operation and/or arrangement of parts, are possible, contemplated by the applicant, within the scope of the appended claims, and may be made and used by one of ordinary skill in the art without departing from the spirit or teachings of the invention and scope of the appended claims. It would be readily apparent to one skilled in the art that there are many other combinations of rigid seal rings 50, 60 having a gap 100 which do not depart from the scope of the present invention.

Because many possible embodiments may be made of the present invention without departing from the scope thereof, it is to be understood that all matter herein set forth or shown in the accompanying drawings is to be interpreted as illustrative and not limiting. Accordingly, the scope of the invention and appended claims is not limited to the embodiments described or shown herein.

What is claimed is:

1. A rolling cutter rock drill bit body with at least one depending leg, a bearing shaft formed on said at least one leg, a rolling cutter rotatably mounted upon the bearing shaft, a bearing cavity formed in the rolling cutter, a lubricant disposed within the bearing cavity, the rolling cutter rock drill bit comprising: first and second energized rigid face seals disposed between the at least one leg and the rolling cutter; said first and second rigid face seals having opposing first and second seal faces, respectively; said first and second seal faces having opposing, engagable first and second sealing surfaces, respectively; each of said first and second sealing surfaces being constructed at least partially of generally wear-resistant material; and a distinct gap comprising a stepped geometry extending from the first and second sealing surfaces, said distinct gap in fluid communication with the bearing cavity, said distinct gap allowing the flow of lubricant from the bearing cavity to said first and second sealing surfaces.

2. The rolling cutter rock drill bit of claim 1 wherein said first and second seal faces include first and second non-engageable surfaces, respectively.

3. The rolling cutter drill bit of claim 2 wherein said generally wear-resistant material includes a tungsten carbide coating.

4. The rolling cutter rock drill bit of claim 3 wherein at least one among said first and second sealing surfaces includes an inner edge adjacent to said non-engageable surface, said inner edge being beveled.

5. The rolling cutter rock drill bit of claim 1 wherein said first and second sealing surfaces do not substantially migrate across said first and second seal faces throughout the life of the rolling cutter rock bit under normal operating conditions.

6. The rolling cutter rock drill bit of claim 5 wherein each of said first and second energized rigid face seals has an inner side in fluid communication with the bearing cavity and wherein said distinct gap extend from said inner side of each of said first and second energized rigid face seals to said first and second sealing surfaces.

7. The rolling cutter rock drill bit of claim 6 wherein said distinct gap has a width of between approximately 0.005 inches and approximately 0.010 inches.

8. The rolling cutter rock drill bit of claim 7 wherein said generally wear-resistant material includes a tungsten carbide coating.

9. A seal arrangement useful in a rolling cutter rock drill bit, the rolling cutter rock drill bit including a bit body with at least one leg having a rolling cutter, rotatably mountable thereupon, a bearing cavity formed within the rolling cutter, lubricant disposed within the bearing cavity, the seal arrangement comprising: first and second rigid rings disposed between the leg of the bit body and the rolling cutter, each of said first and second rigid rings having an inner side in fluid communication with the bearing cavity, said inner said of said first rigid ring being adjacent to said inner side of said second rigid ring; said first and second rigid rings having opposing first and second faces, respectively; said first and second faces having opposing first and second sealing surfaces, respectively; each of said first and second sealing surfaces occupying a portion of said first and second faces respectively, including wear resistant material and being generally non-migrating across said first and second faces; and gap comprising a stepped geometry formed between said first and second faces, said gap extending from said inner side of each of said first and second rigid rings to said first and second sealing surfaces of said first and second faces, said gap allowing lubricant to flow to said first and second sealing surfaces from the bearing cavity.

10. The seal arrangement of claim 9 wherein said gap is a distinct gap.

11. The seal arrangement of claim 10 wherein said wear resistant material includes a tungsten carbide coating.

12. The seal arrangement of claim 9 wherein each of said first and second faces includes a stepped geometry.

13. The seal arrangement of claim 9 wherein said gap has a width of between approximately 0.005 inches and approximately 0.010 inches.

14. A seal arrangement useful in a rolling cutter rock drill bit, the rolling cutter rock drill bit a having a bit body with at least one leg capable of having a rolling cutter rotatably mountable thereupon, a bearing cavity formed within the rolling cutter, and lubricant disposable within the bearing cavity, the seal arrangement comprising; first and second energized rigid rings positionable between the leg of the bit body and the rolling cutter, each of said first and second rigid rings having a first side in fluid communication with the bearing cavity when the seal arrangement is assembled is assembled within the rolling cutter rock drill bit; said first and second sealing faces having opposing first and second seal interface surfaces, respectively; each of said first and second seal interface surfaces having a wear resistant coating; and a gap comprising a stepped geometry formed between said first and second sealing faces when the seal arrangement is assembled within the rolling cutter rock drill bit, said gap extending from said first and second seal interface surfaces of said first and second sealing faces to said first side of each of said and second rigid rings.

15. The seal arrangement of claim 14 wherein said first and second sealing interface surfaces do not migrate across said first and second sealing faces.

16. The seal arrangement of claim 15 wherein said first and second sealing faces include first and second non-engageable surfaces, respectively.

17. The seal arrangement of claim 14 wherein at least one among said first and second sealing faces includes a stepped geometry.

18. A rolling cutter rock drill bit having a bit body with at least one depending leg, a bearing shaft formed on at least one leg, a rolling cutter rotatably mounted upon the bearing shaft, a bearing cavity formed in the rolling cutter, lubricant disposed within the bearing cavity, the rolling cutter rock drill bit comprising: first and second energized rigid rings disposed between the leg of the bit body and the rolling cutter, each of said first and second rigid rings having opposing first and second faces, respectively; said first and second faces having opposing first and second seal interface surfaces respectively; each of said first and second seal interface surfaces having a wear resistant coating and being generally non-migrating across said first and second faces; and said face of at least one among said first and second rigid rings further having a non-engageable surface disposed adjacent to said first side of said at least one rigid ring, said at least one non-engageable surface being non-engageable with said face of said other rigid ring and forming a gap comprising a stepped geometry extending from said first and second seal interface surfaces, said gap allowing the flow of lubricant to said first and second seal interface surfaces.

19. The rolling cutter rock drill bit of claim 18 wherein each of said first and second sealing faces includes a non-engageable surface and has the stepped geometry.

20. The rolling cutter rock drill bit of claim 19 wherein at least one of said seal interface surface includes a beveled edge adjacent to said non-engageable surface.

21. The rolling cutter rock drill bit of claim 15 wherein the wear resistant coating is constructed at least partially of tungsten carbide.

* * * * *